US011348508B2

(12) United States Patent
Park et al.

(10) Patent No.: US 11,348,508 B2
(45) Date of Patent: May 31, 2022

(54) DISPLAY APPARATUS AND METHOD OF DRIVING DISPLAY PANEL USING THE SAME

(71) Applicant: SAMSUNG DISPLAY CO., LTD., Yongin-si (KR)

(72) Inventors: Sehyuk Park, Seongnam-si (KR); Hong Soo Kim, Hwaseong-si (KR); Sangan Kwon, Cheonan-si (KR); Jinyoung Roh, Hwaseong-si (KR); Hyo Jin Lee, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/989,073

(22) Filed: Aug. 10, 2020

(65) Prior Publication Data

US 2021/0056885 A1 Feb. 25, 2021

(30) Foreign Application Priority Data

Aug. 22, 2019 (KR) ..... 10-2019-0103209

(51) Int. Cl.
*G09G 3/20* (2006.01)
*G09G 3/3291* (2016.01)

(52) U.S. Cl.
CPC ..... *G09G 3/2044* (2013.01); *G09G 3/3291* (2013.01); *G09G 2320/0247* (2013.01); *G09G 2320/10* (2013.01)

(58) Field of Classification Search
CPC ..... G09G 3/2044; G09G 2320/0247; G09G 3/2051; G09G 3/2055; G09G 5/02;
(Continued)

(56) References Cited

U.S. PATENT DOCUMENTS

2015/0228216 A1* 8/2015 Lee ..... G09G 3/20 345/691
2015/0339994 A1* 11/2015 Verbeure ..... G09G 3/2044 345/214

(Continued)

FOREIGN PATENT DOCUMENTS

EP 2905770 12/2015
KR 10-2015-0086826 7/2015

OTHER PUBLICATIONS

Extended European Search Report dated Oct. 23, 2020 From the European Patent Office in Corresponding European Patent Appln. No. 20192071.7.

(Continued)

*Primary Examiner* — Sanjiv D. Patel
(74) *Attorney, Agent, or Firm* — F. Chau & Associates, LLC

(57) ABSTRACT

A display apparatus includes a display panel, a data driver and a driving controller. The display panel is configured to display an image based on input image data. The data driver is configured to output a data voltage to the display panel. The driving controller includes a frequency adjuster circuit configured to determine a driving frequency of the display panel, and a dithering circuit configured to change a gray-scale value of the input image data according to frames. The frequency adjuster circuit is configured to determine the driving frequency of the display panel based on the input image data and based on whether the dithering part is activated.

20 Claims, 11 Drawing Sheets

(58) Field of Classification Search
CPC ... G09G 2320/0271; G09G 2320/0276; G09G 2360/02; G09G 3/2029; G09G 2320/0266; G09G 3/2803; G09G 3/2074; G09G 3/2003; G09G 3/2077; G09G 2340/0435; G09G 3/32; G09G 2300/026; H03M 3/3287
See application file for complete search history.

(56) References Cited

U.S. PATENT DOCUMENTS

2015/0340014 A1* 11/2015 Kim ..... G09G 5/10 345/212
2015/0379970 A1* 12/2015 Albrecht ..... G09G 3/2003 345/214

OTHER PUBLICATIONS

Digital Imaging and Communications in Medicine (DICOM) Part 14: Grayscale Standard Display Function (Published By National Electrical Manufacturers Association 1300 N. 17th Street Rosslyn, Virginia 22209 USA) 2004.

* cited by examiner

FIG. 5

| STAGE | INPUT GRAYSCALE VALUE(8bit) | FLICKER VALUE | FREQUENCY(Hz) |
|---|---|---|---|
| 1 | 0-3 | 0 | 1 |
| 2 | 4-7 | 0 | 1 |
| 3 | 8-11 | 40 | 2 |
| 4 | 12-15 | 80 | 5 |
| 5 | 16-19 | 120 | 10 |
| 6 | 20-23 | 160 | 30 |
| 7 | 24-27 | 200 | 60 |
| ⋮ | ⋮ | ⋮ | ⋮ |
| 60 | 236-239 | 0 | 1 |
| 61 | 240-243 | 0 | 1 |
| 62 | 244-247 | 0 | 1 |
| 63 | 248-251 | 0 | 1 |
| 64 | 252-255 | 0 | 1 |

DISPLAY APPARATUS AND METHOD OF DRIVING DISPLAY PANEL USING THE SAME

CROSS-REFERENCE TO RELATED APPLICATIONS

This application claims priority under 35 U.S.C. § 119 to Korean Patent Application No. 10-2019-0103209, filed on Aug. 22, 2019 in the Korean Intellectual Property Office, the disclosure of which is incorporated by reference herein in its entirety.

TECHNICAL FIELD

Exemplary embodiments of the present inventive concept relate to a display apparatus, and a method of driving a display panel using the display apparatus. More particularly, exemplary embodiments of the present inventive concept relate to a display apparatus capable of reducing power consumption and improving display quality, and a method of driving a display panel using the display apparatus.

DISCUSSION OF THE RELATED ART

Methods of reducing power consumption of information technology (IT) products such as, for example, a tablet PC and a notebook PC, have been recently studied.

To reduce the power consumption of IT products which include a display panel, power consumption of the display panel may be reduced to reduce the overall power consumption of the IT products. The display apparatus may include a frequency adjusting part which drives the display panel at a relatively low driving frequency when the display panel displays a still image, and a dithering part which performs a dithering operation which increases a grayscale resolution by slightly adjusting a luminance of the display panel.

When the display apparatus includes both the frequency adjusting part and the dithering part and the display apparatus is driven at the relatively low frequency, a still image may be mistakenly perceived as a video image as a result of the dithering operation.

SUMMARY

Exemplary embodiments of the present inventive concept provide a display apparatus capable of reducing power consumption of the display apparatus and improving display quality of a display panel.

Exemplary embodiments of the present inventive concept also provide a method of driving a display panel using the display apparatus.

In an exemplary embodiment, a display apparatus includes a display panel, a data driver and a driving controller. The display panel is configured to display an image based on input image data. The data driver is configured to output a data voltage to the display panel. The driving controller includes a frequency adjuster circuit configured to determine a driving frequency of the display panel, and a dithering circuit configured to change a grayscale value of the input image data according to frames. The frequency adjuster circuit is configured to determine the driving frequency of the display panel based on the input image data and based on whether the dithering circuit is activated.

In an exemplary embodiment, the frequency adjuster circuit is disposed prior to the dithering part in the driving controller.

In an exemplary embodiment, the frequency adjuster circuit includes a dithering determiner circuit configured to determine whether the dithering circuit is activated, a still image determiner circuit configured to determine whether the input image data represent a still image or a video image, a flicker value storage configured to store a plurality of flicker values for a plurality of corresponding grayscale values of the input image data, and a driving frequency determiner circuit configured to determine the driving frequency of the display panel based on at least one of the flicker values and based on whether the dithering circuit is activated.

In an exemplary embodiment, when the dithering circuit is deactivated, the frequency adjuster circuit is configured to determine the flicker values of respective pixels, and set a maximum driving frequency in which a flicker is not visible to a user as the driving frequency of the display panel based on the flicker values of the respective pixels.

In an exemplary embodiment, when the dithering circuit is activated, the frequency adjuster circuit is configured to determine whether a grayscale value of a pixel at which a difference of a luminance is visible to a user due to a dithering operation performed by the dithering circuit exists among grayscale values of the pixels.

In an exemplary embodiment, when the dithering circuit is activated and the grayscale value of the pixel at which the difference of the luminance is visible to the user exists among the grayscale values of the pixels, the frequency adjuster circuit is configured to set the driving frequency of the display panel to a predetermined dithering frequency.

In an exemplary embodiment, when the dithering circuit is activated and the grayscale value of the pixel at which the difference of the luminance is visible to the user does not exist among the grayscale values of the pixels, the frequency adjuster circuit is configured to determine the flicker values of respective pixels and set a maximum driving frequency at which a flicker is not visible to the user as the driving frequency of the display panel based on the flicker values of the respective pixels.

In an exemplary embodiment, the grayscale value of the pixel at which the difference of the luminance is visible to the user is about equal to or greater than a reference grayscale value.

In an exemplary embodiment, the grayscale value of the pixel at which the difference of the luminance is visible to the user is about equal to or less than a reference grayscale value.

In an exemplary embodiment, the grayscale value of the pixel at which the difference of the luminance is visible to the user is about equal to or greater than a first reference grayscale value and less than a second reference grayscale value.

In an exemplary embodiment, the display panel includes a plurality of segments. The frequency adjuster circuit includes a dithering determiner circuit configured to determine whether the dithering circuit is activated, a still image determiner circuit configured to determine whether the input image data represent a still image or a video image, a flicker value storage configured to store a plurality of flicker values for the segments of the input image data, and a driving frequency determiner circuit configured to determine the driving frequency of the display panel based on at least one of the flicker values and based on whether the dithering circuit is activated.

In an exemplary embodiment, when the dithering circuit is deactivated, the frequency adjuster circuit is configured to determine the flicker values of respective segments, and set a maximum driving frequency at which a flicker is not visible to a user as the driving frequency of the display panel based on the flicker values of the respective segments.

In an exemplary embodiment, when the dithering circuit is activated, the frequency adjuster circuit is configured to determine whether an average grayscale value of a segment at which a difference of a luminance is visible to a user due to a dithering operation performed by the dithering circuit exists among average grayscale values of the segments.

In an exemplary embodiment, when the dithering circuit is activated and the average grayscale value of the segment at which the difference of the luminance is visible to the user exists among the average grayscale values of the segments, the frequency adjuster circuit is configured to set the driving frequency of the display panel to a predetermined dithering frequency.

In an exemplary embodiment, when the dithering circuit is activated and the average grayscale value of the segment at which the difference of the luminance is visible to the user does not exist among the average grayscale values of the segments, the frequency adjuster circuit is configured to determine the flicker values of respective segments and set a maximum driving frequency at which a flicker is not visible to the user as the driving frequency of the display panel based on the flicker values of the respective segments.

In an exemplary embodiment, a method of driving a display panel includes determining a driving frequency of the display panel using a frequency adjuster circuit, changing a grayscale value of input image data input to the display panel according to frames using a dithering circuit, and outputting a data voltage to the display panel based on the driving frequency of the display panel. The frequency adjuster circuit is configured to determine the driving frequency of the display panel based on the input image data and based on whether the dithering circuit is activated.

In an exemplary embodiment, the frequency adjuster circuit is disposed prior to the dithering circuit in a driving controller.

In an exemplary embodiment, the frequency adjuster circuit includes a dithering determiner circuit configured to determine whether the dithering circuit is activated, a still image determiner circuit configured to determine whether the input image data represent a still image or a video image, a flicker value storage configured to store a plurality of flicker values for a plurality of corresponding grayscale values of the input image data, and a driving frequency determiner circuit configured to determine the driving frequency of the display panel based on at least one of the flicker values and based on whether the dithering circuit is activated.

In an exemplary embodiment, determining the driving frequency of the display panel includes determining the flicker values of respective pixels, and setting a maximum driving frequency at which a flicker is not visible to a user as the driving frequency of the display panel based on the flicker values of the respective pixels, when the dithering circuit is deactivated.

In an exemplary embodiment, determining the driving frequency of the display panel includes determining whether a grayscale value of a pixel at which a difference of a luminance is visible to a user due to a dithering operation performed by the dithering circuit exists among grayscale values of the pixels, when the dithering circuit is activated.

According to the display apparatus and the method of driving the display panel using the display apparatus, according to exemplary embodiments, the frequency adjuster circuit may be disposed prior to the dithering circuit, the display apparatus may include a dithering determiner circuit determining whether the dithering circuit is activated, and the driving frequency determiner circuit may determine the driving frequency based on the input image data and whether the dithering part is activated. Thus, the power consumption of the display apparatus may be reduced. In addition, flicker due to the operation of the dithering circuit may be prevented so that the display quality of the display panel may be improved.

BRIEF DESCRIPTION OF THE DRAWINGS

The above and other features of the present inventive concept will become more apparent by describing in detail exemplary embodiments thereof with reference to the accompanying drawings, in which:

FIG. 5 is a table illustrating an exemplary flicker value storage of FIG. 4.

DETAILED DESCRIPTION OF THE EXEMPLARY EMBODIMENTS

Figure 1:
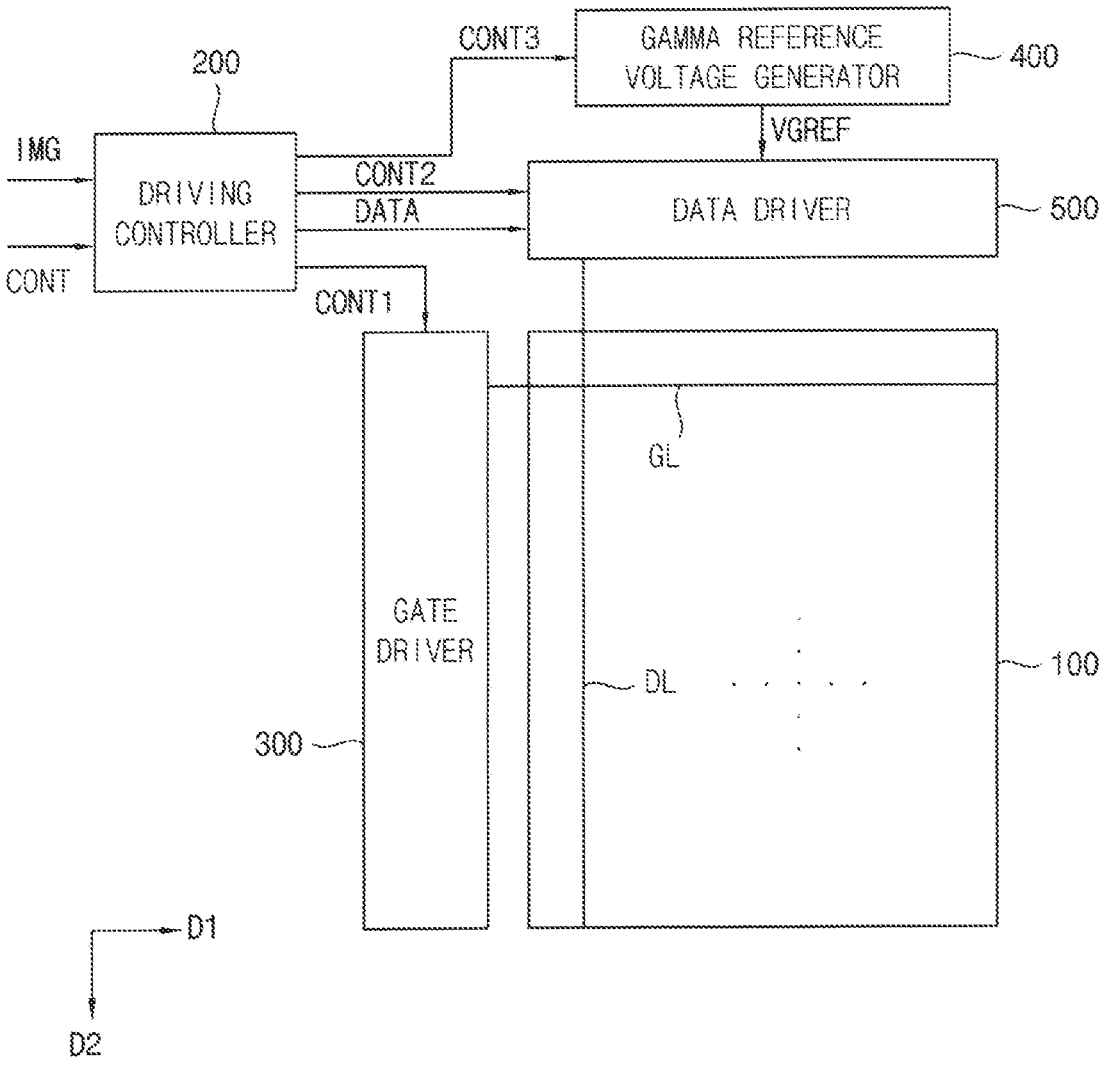
FIG. 1 is a block diagram illustrating a display apparatus according to an exemplary embodiment of the present inventive concept.

Exemplary embodiments of the present inventive concept will be described more fully hereinafter with reference to the accompanying drawings. Like reference numerals may refer to like elements throughout the accompanying drawings.

It will be understood that the terms "first," "second," "third," etc. are used herein to distinguish one element from another, and the elements are not limited by these terms.

Thus, a "first" element in an exemplary embodiment may be described as a "second" element in another exemplary embodiment.

It will be further understood that descriptions of features or aspects within each exemplary embodiment should typically be considered as available for other similar features or aspects in other exemplary embodiments, unless the context clearly indicates otherwise.

As used herein, the singular forms "a", "an" and "the" are intended to include the plural forms as well, unless the context clearly indicates otherwise.

FIG. 1 is a block diagram illustrating a display apparatus according to an exemplary embodiment of the present inventive concept.

Referring to FIG. 1, the display apparatus includes a display panel 100 and a display panel driver. The display panel driver includes a driving controller 200, a gate driver 300, a gamma reference voltage generator 400 and a data driver 500.

According to exemplary embodiments, some of the components included in the display panel driver may be integrally formed. For example, the driving controller 200 and the data driver 500 may be integrally formed, or the driving controller 200, the gamma reference voltage generator 400 and the data driver 500 may be integrally formed. A driving module including at least the driving controller 200 and the data driver 500 which are integrally formed may be referred to as a timing controller embedded data driver (TED).

The display panel 100 includes a plurality of gate lines GL, a plurality of data lines DL and a plurality of pixels connected to the gate lines GL and the data lines DL. The gate lines GL extend in a first direction D1 and the data lines DL extend in a second direction D2 crossing the first direction D1.

The display panel 100 may be, for example, an organic light emitting diode (OLED) display panel including an organic light emitting element. For example, each pixel may include an organic light emitting diode OLED.

The pixel receives a data write gate signal, a data initialization gate signal, an organic light emitting element initialization signal, a data voltage and an emission signal, and the organic light emitting diode of the pixel emits light corresponding to the level of the data voltage to display the image.

In an exemplary embodiment, the pixel may include a switching element of a first type. For example, the switching element of the first type may be a polysilicon thin film transistor. For example, the switching element of the first type may be a low temperature polysilicon (LTPS) thin film transistor. For example, the switching element of the first type may be a P-type transistor.

In an exemplary embodiment, the pixel may include a switching element of a first type and a switching element of a second type different from the first type. For example, the switching element of the first type may be a polysilicon thin film transistor. For example, the switching element of the first type may be a low temperature polysilicon (LTPS) thin film transistor. For example, the switching element of the second type may be an oxide thin film transistor. For example, the switching element of the first type may be a P-type transistor and the switching element of the second type may be an N-type transistor.

Alternatively, the display panel 100 may be a liquid crystal display panel including a liquid crystal layer.

The driving controller 200 receives input image data IMG and an input control signal CONT from an external apparatus. The input image data IMG may include, for example, red image data, green image data and blue image data. The input image data IMG may include, for example, white image data. The input image data IMG may include, for example, magenta image data, yellow image data and cyan image data. The input control signal CONT may include, for example, a master clock signal and a data enable signal. The input control signal CONT may further include, for example, a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include, for example, a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include, for example, a horizontal start signal and a load signal.

The driving controller 200 generates the data signal DATA based on the input image data IMG. The driving controller 200 outputs the data signal DATA to the data driver 500.

For example, the driving controller 200 may adjust a driving frequency of the display panel 100 based on the input image data IMG.

The driving controller 200 generates the third control signal CONT3 for controlling an operation of the gamma reference voltage generator 400 based on the input control signal CONT, and outputs the third control signal CONT3 to the gamma reference voltage generator 400.

The structure and operation of the driving controller 200 are described in further detail with reference to FIGS. 2 to 8C.

The gate driver 300 generates gate signals driving the gate lines GL in response to the first control signal CONT1 received from the driving controller 200. The gate driver 300 outputs the gate signals to the gate lines GL. For example, the gate driver 300 may sequentially output the gate signals to the gate lines GL.

The display panel 100 may include a display region and a peripheral region adjacent to the display region. For example, the gate driver 300 may be mounted in the peripheral region of the display panel 100. For example, the gate driver 300 may be integrated in the peripheral region of the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the driving controller 200, or in the data driver 500. For example, according to exemplary embodiments, the gamma reference voltage generator 400 and the driving controller 200 may be integrally formed, or the gamma reference voltage generator 400 and the data driver 500 may be integrally formed.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The data driver 500 may be mounted, for example, in the peripheral region of the display panel 100. For example, the data driver 500 may be integrated in the peripheral region of the display panel 100.

Figure 2:
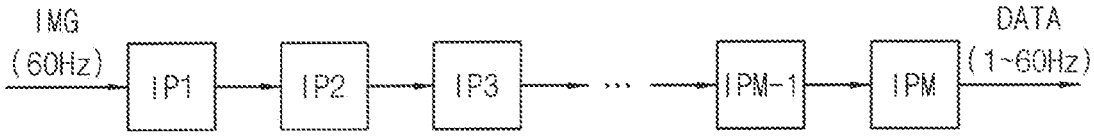
FIG. 2 is a block diagram illustrating a driving controller of FIG. 1 according to an exemplary embodiment of the present inventive concept.
Figure 3:
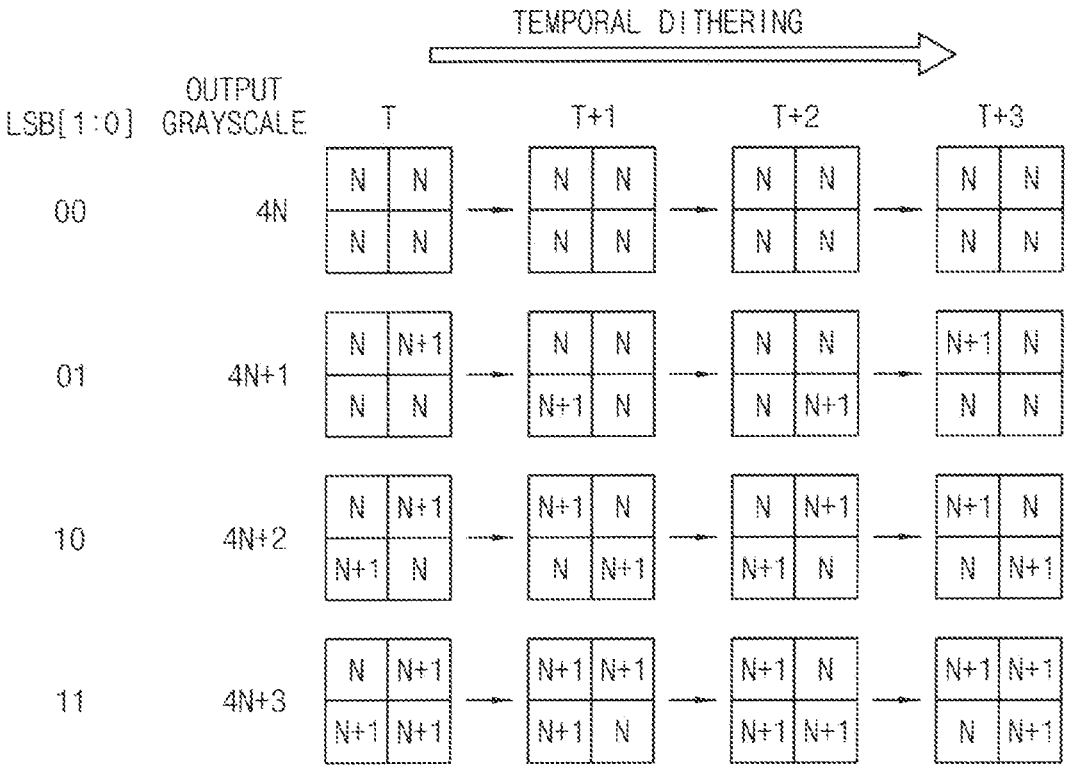
FIG. 3 is a conceptual diagram illustrating an operation of a dithering part of FIG. 2 according to an exemplary embodiment of the present inventive concept.

FIG. 2 is a block diagram illustrating the driving controller 200 of FIG. 1 according to an exemplary embodiment of the present inventive concept. FIG. 3 is a conceptual diagram illustrating an operation of a dithering part of FIG. 2 according to an exemplary embodiment of the present inventive concept.

Referring to FIGS. 1 to 3, the driving controller 200 may include a plurality of control logics IP1, IP2, IP3, . . . , IPM-1 and IPM. Each of the control logics IP1, IP2, IP3, . . . , IPM-1 and IPM may also be referred to as an intellectual property (IP) block.

For example, the control logics IP1, IP2, IP3, . . . , IPM-1 and IPM may generate the data signal DATA based on the input image data IMG and the input control signal CONT.

For example, the control logics IP1, IP2, IP3, . . . , IPM-1 and IPM may compensate the input image data IMG or the data signal DATA based on the input image data IMG and the input control signal CONT.

For example, the control logics IP1, IP2, IP3, . . . , IPM-1 and IPM may determine and set a driving frequency of the display apparatus based on the input image data IMG and the input control signal CONT.

For example, the control logics IP1, IP2, IP3, . . . , IPM-1 and IPM may generate and compensate the first to third control signals CONT1, CONT2 and CONT3 based on the input image data IMG and the input control signal CONT.

The driving controller 200 may include, for example, a dithering part and a frequency adjuster. For example, each of the dithering part and the frequency adjuster may be one of the control logics IP1, IP2, IP3, . . . , IPM-1 and IPM. Each of the control logics IP1, IP2, IP3, . . . , IPM-1 and IPM may be, for example, an electronic circuit. Thus, the dithering part may also be referred to herein as a dithering circuit, and the frequency adjuster may also be referred to herein as a frequency adjuster circuit.

The dithering part may extend the number of bits of the input image data IMG or the data signal DATA to increase a grayscale resolution of the input image data IMG or the data signal DATA. For example, the dithering part may execute a dithering operation, which may reconstitute an image signal generated by extracting upper bits of the input image data IMG or the data signal DATA corresponding to bits processible in the driving controller 200 or the data driver 500 according to a selected dithering pattern based on lower bits in a unit of a frame. For example, the dithering pattern may be a set of compensating values corresponding to pixels. Performing the dithering operation may result in the luminance of the display panel being slightly adjusted, which may improve the grayscale resolution. The dithering part may store a plurality of dithering patterns which vary according to grayscales and frames to use for the dithering operation. As a result, the dithering part may perform a dithering operation under various conditions involving different grayscales and different frames. The dithering patterns may be repetitive in a number of frames and the dithering patterns may have a repetitive cycle.

For example, in FIG. 3, the number (e.g. ten bits) of output bits of the dithering part may be greater than the number (e.g. eight bits) of input bits of the dithering part by two bits.

When the data of the upper bits is N and the data of the lower two bits LSB[1:0] is "00", an output grayscale value of the dithering part may be 4N. When the data of the upper bits is N and the data of the lower two bits LSB[1:0] is "00", four adjacent pixels may represent the data N of the upper bits, and each of the four adjacent pixels may represent the data N of the upper bits during four adjacent frames T, T+1, T+2 and T+3.

When the data of the upper bits is N and the data of the lower two bits LSB[1:0] is "01", the output grayscale value of the dithering part may be 4N+1. When the data of the upper bits is N and the data of the lower two bits LSB[1:0] is "01", one of the four adjacent pixels may represent a sum N+1 of the data N of the upper bits and 1, and remaining pixels of the four adjacent pixels may represent the data N of the upper bits. In addition, the four adjacent pixels may respectively represent the sum N+1 of the data N of the upper bits and 1 during one of four adjacent frames T, T+1, T+2 and T+3, and represent the data N of the upper bits during remaining frames of four adjacent frames T, T+1, T+2 and T+3. Accordingly, an average luminance of the four adjacent pixels may be N+0.25 in a frame. In addition, an average luminance of a single pixel may be N+0.25 during the four adjacent frames T1, T+1, T+2 and T+3.

When the data of the upper bits is N and the data of the lower two bits LSB[1:0] is "10", the output grayscale value of the dithering part may be 4N+2. When the data of the upper bits is N and the data of the lower two bits LSB[1:0] is "10", two of the four adjacent pixels may represent a sum N+1 of the data N of the upper bits and 1, and remaining pixels of the four adjacent pixels may represent the data N of the upper bits. In addition, the four adjacent pixels may respectively represent the sum N+1 of the data N of the upper bits and 1 during two of four adjacent frames T, T+1, T+2 and T+3, and represent the data N of the upper bits during remaining frames of four adjacent frames T, T+1, T+2 and T+3. Accordingly, an average luminance of the four adjacent pixels may be N+0.5 in a frame. In addition, an average luminance of a single pixel may be N+0.5 during the four adjacent frames T1, T+1, T+2 and T+3.

When the data of the upper bits is N and the data of the lower two bits LSB [1:0] is "11", the output grayscale value of the dithering part may be 4N+3. When the data of the upper bits is N and the data of the lower two bits LSB[1:0] is "11", three of the four adjacent pixels may represent a sum N+1 of the data N of the upper bits and 1, and a remaining pixel of the four adjacent pixels may represent the data N of the upper bits. In addition, the four adjacent pixels may respectively represent the sum N+1 of the data N of the upper bits and 1 during three of four adjacent frames T, T+1, T+2 and T+3, and represent the data N of the upper bits during a remaining frame of four adjacent frames T, T+1, T+2 and T+3. Accordingly, an average luminance of the four adjacent pixels may be N+7.5 in a frame. In addition, an average luminance of a single pixel may be N+7.5 during the four adjacent frames T1, T+1, T+2 and T+3.

For example, the frequency adjuster may determine and set a driving frequency of the display apparatus based on the input image data IMG. When the input image data IMG represent a still image, the frequency adjuster may determine and set the driving frequency of the display apparatus to a relatively low driving frequency. When the input image data IMG represent a video image, the frequency adjuster may determine and set the driving frequency of the display apparatus to a relatively high driving frequency. In addition, when the input image data IMG represent a still image, the frequency adjuster may determine and set the driving frequency of the display apparatus based on the flicker value according to the grayscale value of the input image data IMG.

When the dithering part is disposed after the frequency adjuster in the driving controller 200 and the input image data IMG represent a still image, the frequency adjuster may determine and set the driving frequency of the display apparatus to the relatively low driving frequency. However, when the output grayscale value of the dithering part is changed to 4N+1, 4N+2 or 4N+3 by the operation of the dithering part, as described above, the grayscale value of each pixel may be switched between N and N+1 according to frames. When the grayscale value of the pixel is switched according to frames, the image displayed on the display panel 100 may mistakenly display like a video image even though the input image data IMG actually represent a still image. Thus, flicker may be generated as a result of the low frequency driving operation.

When the frequency adjuster is disposed after the dithering part in the driving controller 200, the above-described flicker caused by the dithering operation may be prevented. However, it may be preferable to dispose the frequency adjuster prior to the dithering part instead of after the dithering part, as doing so may maximally reduce the power consumption. Thus, in an exemplary embodiment, the frequency adjuster may be disposed prior to the dithering part. For example, referring to FIG. 2, the frequency adjuster may be a first control logic IP1 and the dithering part may be a second control logic IP2.

Herein, when the frequency adjuster is described as being disposed prior to the dithering part in the driving controller 200, it means that within the driving controller 200, the frequency adjuster is disposed closer to the input (e.g., input image data IMG) received by the driving controller 200 compared to the dithering part, and that the operations of the frequency adjuster are performed prior to the operations of the dithering part and may affect the operations of the dithering part. For example, when the frequency adjuster is disposed prior to the dithering part in the driving controller 200, when the frequency adjuster adjusts the driving frequency, the dithering part is driven at the adjusted frequency as set by the frequency adjuster.

For example, when the frequency adjuster is the first control logic IP1, the second to M-th control logics IP2, IP3, . . . , IPM-1 and IPM may be driven at the driving frequency determined and set by the frequency adjuster. For example, when the frequency adjuster is the first control logic IP1 and the driving frequency of the display apparatus is determined and set to 1 Hz by the frequency adjuster, the second to M-th control logics IP2, IP3, . . . , IPM-1 and IPM may be driven at 1 Hz. Thus, the power consumption of the display apparatus may be further reduced.

Figure 4:
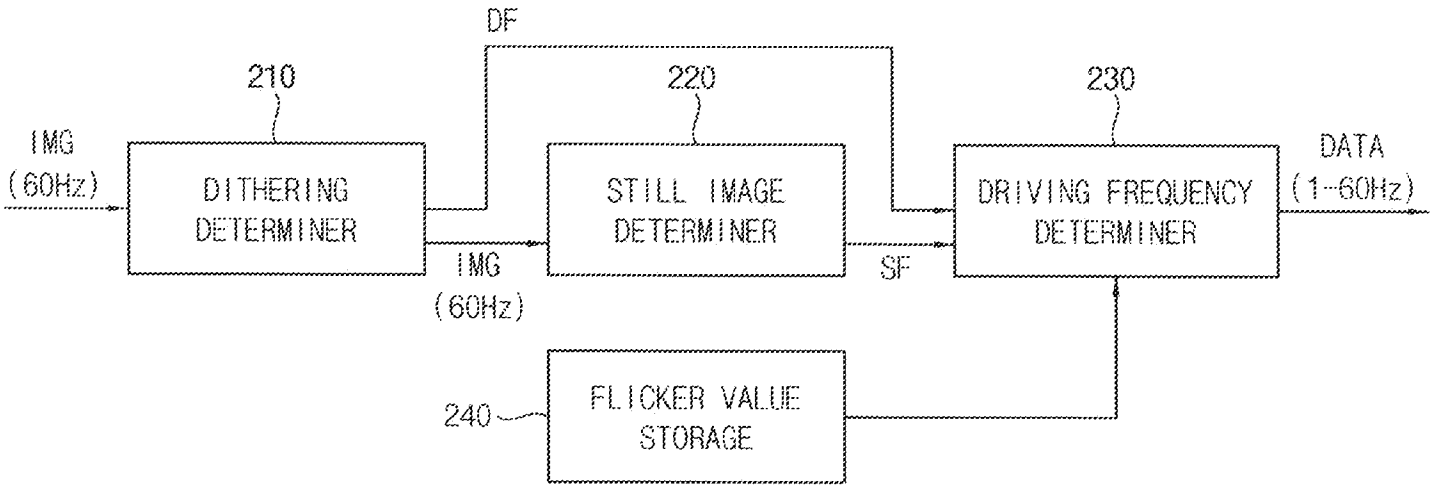
FIG. 4 is a block diagram illustrating a frequency adjuster of FIG. 2 according to an exemplary embodiment of the present inventive concept.

FIG. 4 is a block diagram illustrating the frequency adjuster of FIG. 2 according to an exemplary embodiment of the present inventive concept. FIG. 5 is a table illustrating an exemplary flicker value storage of FIG. 4.

Referring to FIGS. 4 and 5, the frequency adjuster may further include a dithering determiner 210, a still image determiner 220, a driving frequency determiner 230 and a flicker value storage 240. Each of the dithering determiner 210, the still image determiner 220, and the driving frequency determiner 230 may be, for example, an electronic circuit. Thus, the dithering determiner 210 may also be referred to herein as a dithering determiner circuit, the still image determiner 220 may also be referred to herein as a still image determiner circuit, and the driving frequency determiner 230 may also be referred to herein as a driving frequency determiner circuit. The flicker value storage 240 may be a storage device such as, for example, a flash memory, that stores data.

The dithering determiner 210 may determine whether the dithering part is activated or deactivated. The dithering determiner 210 may generate a dithering flag DF representing whether the dithering part is activated or deactivated, and may output the dithering flag DF to the driving frequency determiner 230.

The still image determiner 220 may determine whether the input image data IMG is a still image or a video image. The still image determiner 220 may output a still image flag SF representing whether the input image data IMG is a still image or a video image to the driving frequency determiner 230. For example, when the input image data IMG is a still image, the still image determiner 220 may output the still image flag SF of 1 to the driving frequency determiner 230. When the input image data IMG is a video image, the still image determiner 220 may output the still image flag SF of 0 to the driving frequency determiner 230. When the display panel 100 is operated in an always-on mode, the still image determiner 220 may output the still image flag SF of 1 to the driving frequency determiner 230.

When the still image flag SF is 1, the driving frequency determiner 230 may drive the switching elements in the pixel at a low driving frequency.

When the still image flag SF is 0, the driving frequency determiner 230 may drive the switching elements in the pixel at a normal driving frequency.

The driving frequency determiner 230 may refer to the flicker value storage 240 to determine which driving frequency should be utilized. The flicker value storage 240 may include a flicker value representing a degree of a flicker according to a grayscale value of the input image data IMG.

The flicker value storage 240 may store the grayscale value of the input image data IMG and the flicker value corresponding to the grayscale value of the input image data IMG. The flicker value may be used for determining and setting the driving frequency of the display panel 100. For example, the flicker value storage 240 may store grayscale values and corresponding flicker values in a lookup table.

In FIG. 5, the input grayscale value of the input image data IMG may be 8 bits, the minimum grayscale value of the input image data IMG may be 0 and the maximum grayscale value of the input image data IMG may be 255. The number of flicker setting stages of the flicker value storage 240 may be 64. When the number of the flicker setting stages increases, the flicker may be effectively removed, but a logic size of the driving controller 200 may increase. Thus, the number of the flicker setting stages may be limited.

Although the input grayscale value of the input image data IMG is 8 bits in FIG. 5, the present inventive concept is not limited thereto.

In FIG. 5, the number of the grayscale values of the input image data IMG is 256 and the number of the flicker setting stages is 64. As a result, a single flicker value in the flicker value storage 240 may correspond to four grayscale values. For example, a first flicker setting stage stores the flicker value of 0 for the grayscale values of 0 to 3. Herein, the flicker value of 0 may represent the driving frequency of 1 Hz. For example, a second flicker setting stage stores the flicker value of 0 for the grayscale values of 4 to 7. For example, a third flicker setting stage stores the flicker value of 40 for the grayscale values of 8 to 11. Herein, the flicker value of 40 may represent the driving frequency of 2 Hz. For example, a fourth flicker setting stage stores the flicker value of 80 for the grayscale values of 12 to 15. Herein, the flicker value of 80 may represent the driving frequency of 5 Hz. For example, a fifth flicker setting stage stores the flicker value of 120 for the grayscale values of 16 to 19. Herein, the flicker value of 120 may represent the driving frequency of 10 Hz. For example, a sixth flicker setting stage stores the flicker value of 160 for the grayscale values of 20 to 23. Herein, the flicker value of 160 may represent the driving frequency of 30 Hz. For example, a seventh flicker setting stage stores the flicker value of 200 for the grayscale values of 24 to 27. Herein, the flicker value of 200 may represent the driving frequency of 60 Hz. For example, a sixty-second flicker setting stage stores the flicker value of 0 for the grayscale values of 244 to 247. For example, a sixty-third flicker setting stage stores the flicker value of 0 for the grayscale values of 248 to 251. For example, a sixty-fourth flicker setting stage stores the flicker value of 0 for the grayscale values of 252 to 255.

In an exemplary embodiment, the driving frequency determiner 230 may determine and set the driving frequency based on the input image data IMG and a state DF of the dithering part. The state of the dithering part may refer to whether the dithering part is present, or if present, whether the dithering part is activated or deactivated. For example, the driving frequency determiner 230 may determine and set the driving frequency of the display panel 100 based on the flicker value according to the grayscale value of the input image data IMG and the state of the dithering part (e.g., based on the input image data IMG and based on whether the dithering part is activated).

The display panel 100 may be driven in a normal driving mode in which the display panel 100 is driven at a normal driving frequency, and in a low frequency driving mode in which the display panel 100 is driven at a frequency less than the normal driving frequency.

For example, when the input image data IMG represent a video image, the display panel 100 may be driven in the normal driving mode at the normal driving frequency. For example, when the input image data IMG represent a still image, the display panel may be driven in the low frequency driving mode at the low driving frequency. For example, when the display apparatus is operated in the always-on mode, the display panel may be driven in the low frequency driving mode at the low driving frequency.

The display panel 100 may be driven in a unit of a frame. The display panel 100 may be refreshed in every frame in the normal driving mode. Thus, the normal driving mode includes only writing frames in which the data is written in the pixel.

The display panel 100 may be refreshed at the low frequency in the low frequency driving mode. Thus, the low frequency driving mode includes the writing of frames in which the data is written in the pixel, and the holding of frames in which the written data is maintained without writing the data in the pixel.

For example, when the frequency of the normal driving mode is 60 Hz and the frequency of the low frequency driving mode is 1 Hz, the low frequency driving mode includes one writing frame and 59 holding frames in a second. For example, when the frequency of the normal driving mode is 60 Hz and the frequency of the low frequency driving mode is 1 Hz, 59 continuous holding frames are disposed between two adjacent writing frames.

For example, when the frequency of the normal driving mode is 60 Hz and the frequency of the low frequency driving mode is 10 Hz, the low frequency driving mode includes ten writing frames and 50 holding frames in a second. For example, when the frequency of the normal driving mode is 60 Hz and the frequency of the low frequency driving mode is 10 Hz, five continuous holding frames are disposed between two adjacent writing frames.

Figure 6:
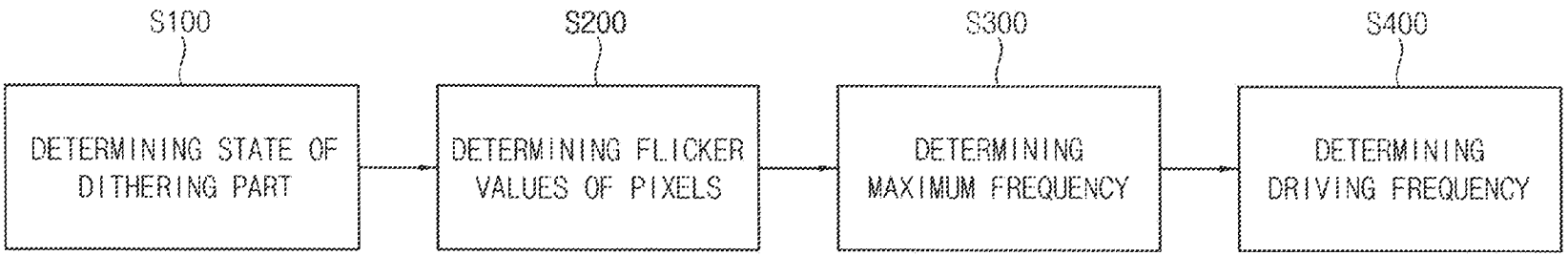
FIG. 6 is a flowchart illustrating an operation of the frequency adjuster of FIG. 4 when the dithering part is deactivated according to an exemplary embodiment of the present inventive concept.
Figure 7:
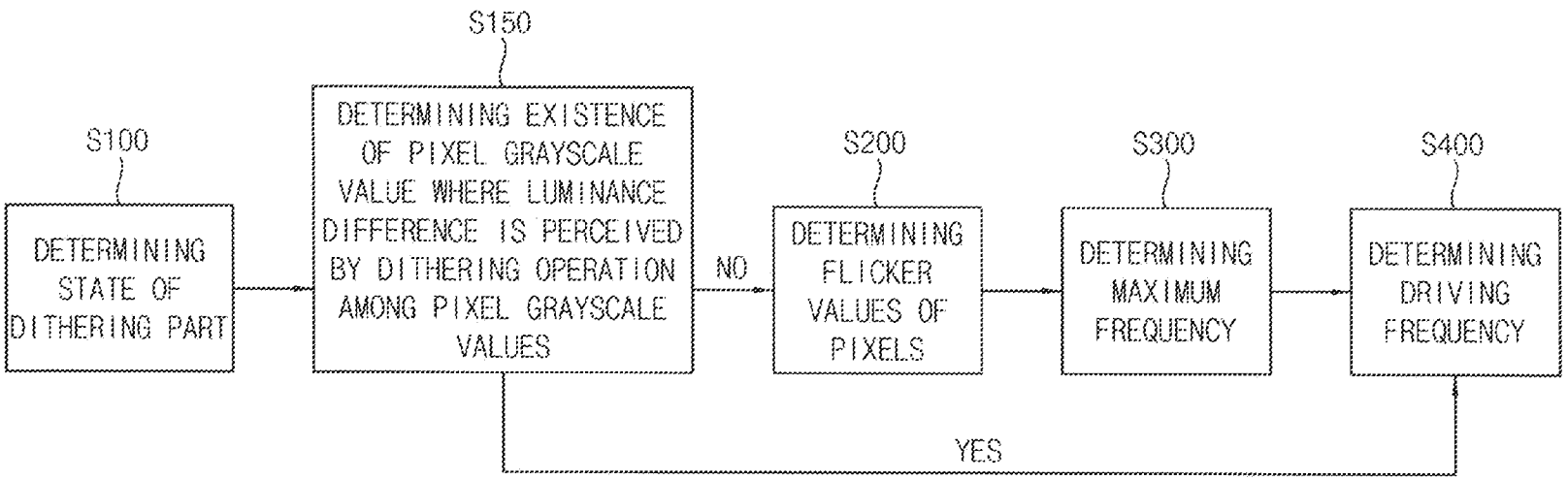
FIG. 7 is a flowchart illustrating an operation of the frequency adjuster of FIG. 4 when the dithering part is activated according to an exemplary embodiment of the present inventive concept.
Figure 8A:
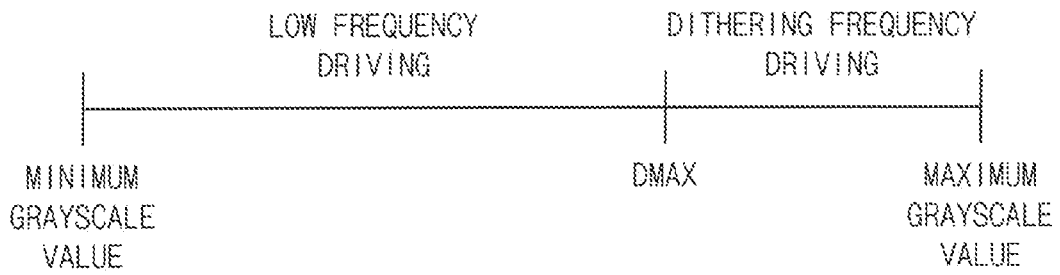
FIGS. 8A, 8B and 8C illustrate examples of a grayscale value at which a difference of luminance is perceived by the dithering operation of FIG. 7.
Figure 8B:
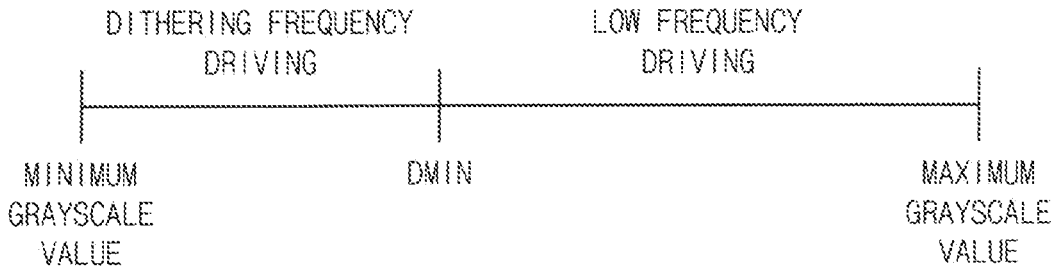
Figure 8C:
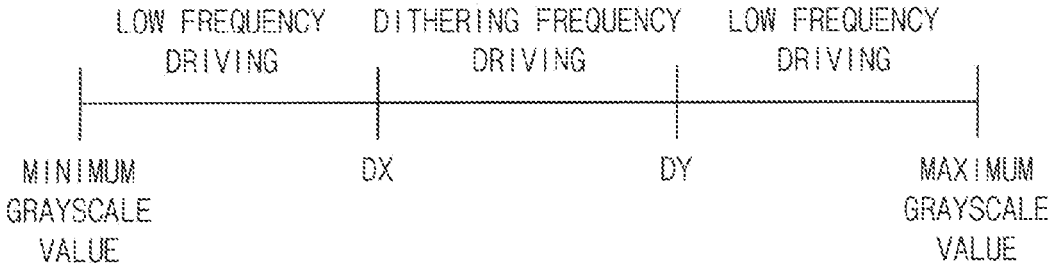

FIG. 6 is a flowchart illustrating an operation of the frequency adjuster of FIG. 4 when the dithering part is deactivated according to an exemplary embodiment of the present inventive concept. FIG. 7 is a flowchart illustrating an operation of the frequency adjuster of FIG. 4 when the dithering part is activated according to an exemplary embodiment of the present inventive concept. FIGS. 8A, 8B and 8C illustrate examples of a grayscale value at which a difference of luminance is visible to a user due to the dithering operation of FIG. 7.

Hereinafter, the operation of the frequency adjuster according to an exemplary embodiment is described with reference to FIGS. 6, 7 and 8A to 8C. For example, in an exemplary embodiment described hereinafter, the flicker value may be generated in a unit of the pixel.

The frequency adjuster may determine the state of the dithering part. For example, the frequency adjuster may determine whether the dithering part is present, and if the dithering part is present, whether the dithering part is activated or deactivated (operation S100).

Referring to FIG. 6, it is assumed that in operation S100, it is determined that the dithering part is deactivated (or is not present). When the dithering part is deactivated (or is not present), a still image is not perceived as a video image by the dithering operation, since the dithering operation is not performed. Thus, when the dithering part is deactivated (or is not present) as is the case in FIG. 6, the frequency adjuster may determine the flicker values of the respective pixels (operation S200), may determine a maximum driving frequency at which flicker is not shown to a user (operation S300), and may determine and set the maximum driving frequency as the driving frequency of the display panel 100 (operation S400) (low frequency driving mode). For example, the maximum driving frequency at which flicker is not shown to a user, as determined in operation S300, may be set as the driving frequency of the display panel 100 in operation S400.

In contrast, when the dithering part is activated, a still image may be mistakenly perceived as a video image by the dithering operation performed by the dithering part. When the output grayscale value is 4N in FIG. 3, the grayscale value of the pixel is not changed in frames, and as a result, a still image is not mistakenly perceived as a video image. However, when the output grayscale value is one of 4N+1, 4N+2 and 4N+3 in FIG. 3, the grayscale value of the pixel is changed in frames, and as a result, a still image may be mistakenly perceived as a video image. Although the grayscale value of the pixel is switched between N and N+1 according to frames in FIG. 3, and accordingly, the difference of the luminance corresponds to one grayscale value (which is the difference between N+1 and N) according to the frames, the present inventive concept is not limited thereto. For example, the difference of the luminance may be greater than one grayscale value according to the frames according to a dithering method.

Referring to FIG. 7, it is assumed that in operation S100, it is determined that the dithering part is present and is activated. When the dithering part is activated, the frequency adjuster may determine whether a grayscale value of a pixel at which a difference of luminance is visible to a user as a result of the dithering operation performed by the dithering part exists among the grayscale values of the pixels (operation S150). For example, among the pixels having grayscale values, the frequency adjuster determines whether any of the pixels has a grayscale value at which a difference of luminance is visible to the user as a result of the dithering operation. When the difference of the luminance corresponds to one grayscale value according to the frames, the difference of the luminance corresponding to one grayscale value may be visible to the user in a specific grayscale area or not in another grayscale area.

When the difference of the luminance corresponding to one grayscale value is visible to the user, a still image may be mistakenly perceived as a video image to the user as a result of the dithering operation. In contrast, when the difference of the luminance corresponding to one grayscale value is not visible to the user, a still image is not mistakenly perceived by the user as a video image due to the dithering operation.

The grayscale area at which the difference of the grayscale value generated by the dithering operation is perceived as the difference of the luminance to the user may be varied according to characteristics of the display panel 100.

In FIG. 8A, the grayscale area at which the difference of the grayscale value generated by the dithering operation is perceived as the difference of the luminance by the user may be a grayscale area (e.g. a high luminance area) about equal to or greater than a first reference grayscale value DMAX.

In FIG. 8B, the grayscale area at which the difference of the grayscale value generated by the dithering operation is perceived as the difference of the luminance by the user may be a grayscale area (e.g. a low luminance area) about equal to or less than a second reference grayscale value DMIN.

In FIG. 8C, the grayscale area at which the difference of the grayscale value generated by the dithering operation is perceived as the difference of the luminance by the user may be a grayscale area (e.g. a medium luminance area) about equal to or greater than a third reference grayscale value DX and less than a fourth reference grayscale value DY.

When the dithering part is activated and the grayscale value of the pixel at which the difference of the luminance is perceived by the user due to the dithering operation exists among the grayscale values of the pixels, the frequency adjuster may determine and set the driving frequency of the display panel 100 to a predetermined dithering frequency (operation S400) (e.g., in the normal driving mode or a dithering driving mode). The predetermined dithering frequency may mean a frequency in which the difference of the luminance is not perceived by the user by the dithering operation. For example, the dithering frequency may be an input frequency (e.g. 60 Hz) of the input image data IMG. Alternatively, the dithering frequency (e.g. 30 Hz) may be greater than the low driving frequency and greater than the input frequency (e.g. 60 Hz) of the input image data IMG.

When the dithering part is activated and a grayscale value of a pixel at which a difference of the luminance is perceived by the user due to the dithering operation does not exist among the grayscale values of the pixels, the frequency adjuster may determine and set the driving frequency of the display panel 100 (the low frequency driving mode) in the same manner as when the dithering part is deactivated (or is not present).

When the dithering part is activated and a grayscale value of a pixel at which a difference of the luminance is perceived by the user due to the dithering operation does not exist among the grayscale values of the pixels, the frequency adjuster may determine the flicker values of the respective pixels (operation S200), may determine a maximum driving frequency in which flicker is not shown to a user (operation S300), and may determine and set the maximum driving frequency as the driving frequency of the display panel 100 (operation S400) (in the low frequency driving mode).

According to an exemplary embodiment, the frequency adjuster may be disposed prior to the dithering part, the display apparatus may include the dithering determiner 210 determining whether the dithering part is activated, and the display apparatus may include the driving frequency determiner 230 determining and setting the driving frequency based on the input image data IMG and whether the dithering part is activated. Thus, the power consumption of the display apparatus may be reduced. In addition, flicker due to the operation of the dithering part may be prevented so that the display quality of the display panel 100 may be improved.

Figure 9:
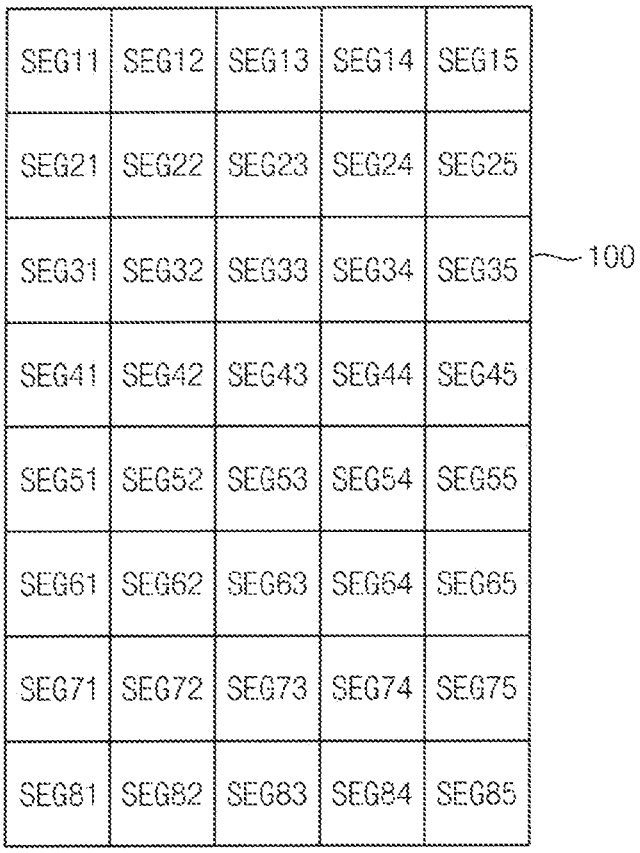
FIG. 9 is a conceptual diagram illustrating a display panel of a display apparatus according to an exemplary embodiment of the present inventive concept.
Figure 10:
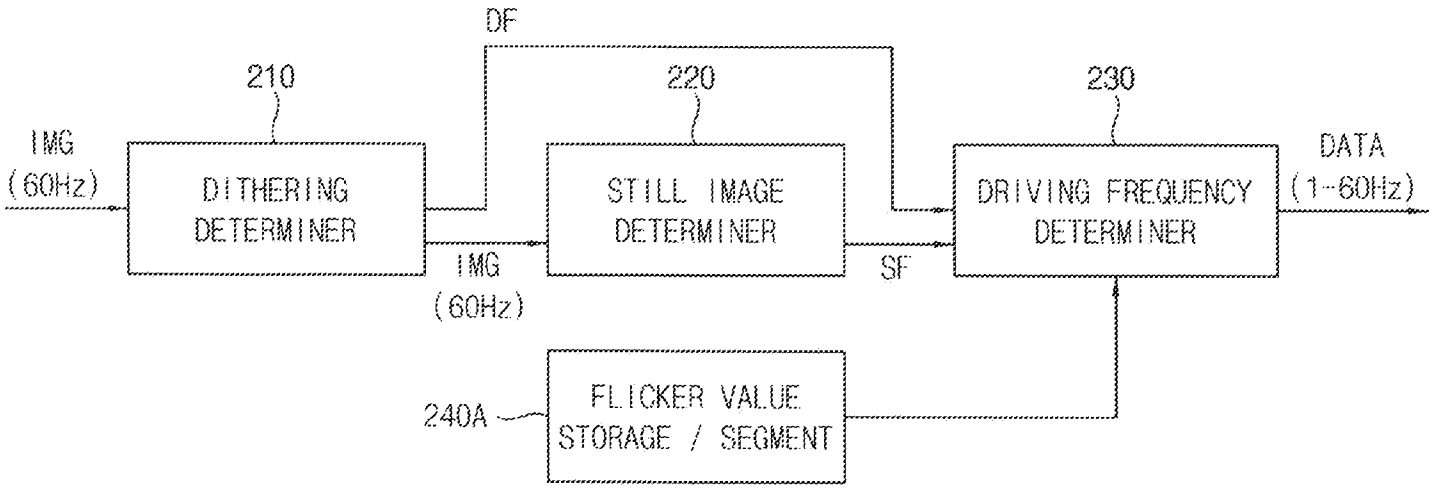
FIG. 10 is a block diagram illustrating a frequency adjuster of the display apparatus of FIG. 9 according to an exemplary embodiment of the present inventive concept.
Figure 11:
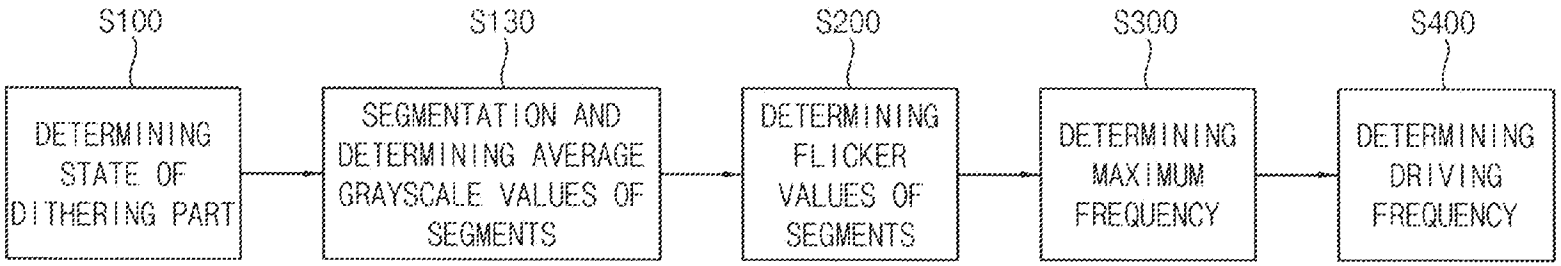
FIG. 11 illustrates an operation of the frequency adjuster of FIG. 10 when the dithering part is deactivated according to an exemplary embodiment of the present inventive concept.
Figure 12:
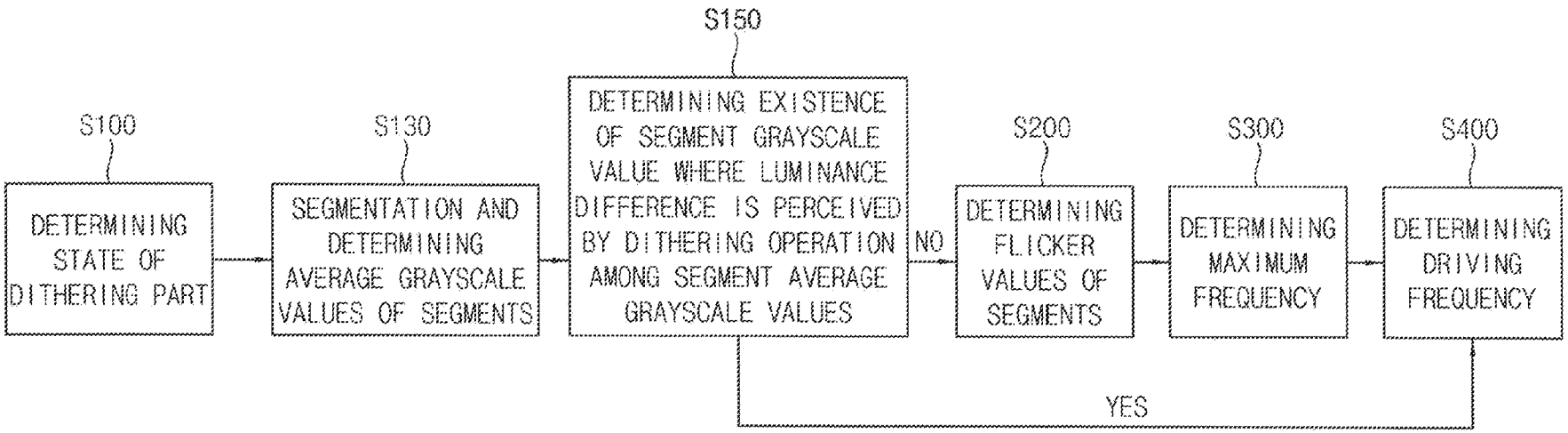
FIG. 12 illustrates an operation of the frequency adjuster of FIG. 10 when the dithering part is activated according to an exemplary embodiment of the present inventive concept.

FIG. 9 is a conceptual diagram illustrating a display panel of a display apparatus according to an exemplary embodiment of the present inventive concept. FIG. 10 is a block diagram illustrating a frequency adjuster of the display apparatus of FIG. 9 according to an exemplary embodiment of the present inventive concept. FIG. 11 illustrates an operation of the frequency adjuster of FIG. 10 when the dithering part is deactivated according to an exemplary embodiment of the present inventive concept. FIG. 12 illustrates an operation of the frequency adjuster of FIG. 10 when the dithering part is activated according to an exemplary embodiment of the present inventive concept.

The display apparatus and the method of driving the display panel according to an exemplary embodiment described with reference to FIGS. 9 to 12 is substantially the same as the display apparatus and the method of driving the display panel according to an exemplary embodiment described with reference to FIGS. 1 to 7 and 8A to 8C, except that the display panel is divided into a plurality of segments. Thus, for convenience of explanation, the same reference numerals will be used to refer to the same or like parts as those described above with reference to FIGS. 1 to 7 and 8A to 8C, and any repetitive explanation thereof will be omitted.

Referring to FIGS. 1 to 3 and 9 to 12, the display panel 100 may include a plurality of segments SEG11 to SEG85. Although the display panel 100 includes the segments in an eight by five matrix in FIG. 9, the present inventive concept is not limited thereto.

When the flicker value is determined for a unit of the pixel and only one pixel has a high flicker value, the entire display panel 100 may be driven at a high driving frequency to prevent flicker in the one pixel. For example, when flicker of only one pixel is prevented at the driving frequency of 30 Hz and the other pixels do not generate flicker at the driving frequency of 1 Hz, the display panel 100 may be driven at the driving frequency of 30 Hz, and the power consumption of the display apparatus may thus be higher than necessary.

In an exemplary embodiment, when the display panel 100 is divided into the segments and the flicker value is determined for a unit of the segment, the power consumption of the display apparatus may be effectively reduced by setting driving frequencies differently based on the segments.

For example, the driving controller 200 may include a dithering part and a frequency adjuster. In an exemplary embodiment, the frequency adjuster may be disposed prior to the dithering part in the driving controller 200.

In an exemplary embodiment, the frequency adjuster may determine optimal driving frequencies for the segments, and may determine and set the maximum driving frequency among the optimal driving frequencies for the segments as the low driving frequency of the display panel 100.

For example, when an optimal driving frequency for a first segment SEG11 is 10 Hz and optimal driving frequencies for the other segments SEG12 to SEG85 except for the first segment SEG11 are 2 Hz, the frequency adjuster may determine and set the low driving frequency to 10 Hz.

The frequency adjuster may include a dithering determiner 210, a still image determiner 220, a driving frequency determiner 230 and a flicker value storage 240A. The dithering determiner 210 may also be referred to herein as a dithering determiner circuit, the still image determiner 220 may also be referred to herein as a still image determiner circuit, and the driving frequency determiner 230 may also be referred to herein as a driving frequency determiner circuit. The flicker value storage 240A may be a storage device such as, for example, a flash memory, that stores data.

The dithering determiner 210 may determine whether the dithering part is activated or deactivated. The dithering determiner 210 may generate a dithering flag DF representing whether the dithering part is activated or deactivated, and may output the dithering flag DF to the driving frequency determiner 230.

In an exemplary embodiment, the driving frequency determiner 230 may refer to the flicker value storage 240A and information of the segment of the display panel 100 to determine and set the low driving frequency.

In an exemplary embodiment, the driving frequency determiner 230 may determine and set the driving frequency based on the input image data IMG and a state DF of the dithering part (e.g. an activation/deactivation state of the dithering part). For example, the driving frequency determiner 230 may determine and set the driving frequency of the display panel 100 based on the flicker value according to the grayscale value of the input image data IMG and the state of the dithering part.

Hereinafter, the operation of the frequency adjuster is described with reference to FIGS. 11 and 12. For example, the flicker value may be generated in a unit of the segment in an exemplary embodiment according to FIGS. 11 and 12.

The frequency adjuster may determine whether the dithering part is activated or deactivated (or whether the dithering part is present) (operation S100). It is assumed that in operation S100 in FIG. 11, it is determined that the dithering part is deactivated. Further, it is assumed that in operation S100 in FIG. 12, it is determined that the dithering part is present and active.

The frequency adjuster may divide the input image data IMG into the segments and calculate average grayscale values of the respective segments (operation S130).

When the dithering part is deactivated (or is not present), a still image is not mistakenly perceived as a video image, since a dithering operation is not performed. Thus, when the dithering part is deactivated (or is not present), as is the case in FIG. 11, the frequency adjuster may determine the flicker values of the respective segments (operation S200), may determine a maximum driving frequency in which flicker is not shown to a user (operation S300), and may determine and set the maximum driving frequency determined in operation S300 as the driving frequency of the display panel 100 (operation S400) (the low frequency driving mode).

In contrast, when the dithering part is activated, a still image may be mistakenly perceived as a video image by the dithering operation.

When the dithering part is activated, as is the case in FIG. 12, the frequency adjuster may determine whether an average grayscale value of a segment at which the difference of the luminance is perceived by a user due to the dithering operation exists among the average grayscale values of the segments (operation S150). The grayscale area at which the difference of the grayscale value generated by the dithering operation is perceived as the difference of the luminance by the user may be varied according to characteristics of the display panel 100, as illustrated in FIGS. 8A to 8C.

When the dithering part is activated and the average grayscale value of the segment at which the difference of the luminance is perceived by the user due to the dithering operation exists among the average grayscale values of the segments, the frequency adjuster may determine and set the driving frequency of the display panel 100 to a predetermined dithering frequency (operation S400) (the normal driving mode or a dithering driving mode). The predetermined dithering frequency refers to a frequency at which the difference of the luminance is not perceived by the user due to the dithering operation. For example, the dithering frequency may be an input frequency (e.g. 60 Hz) of the input image data IMG. Alternatively, the dithering frequency (e.g. 30 Hz) may be greater than the driving frequency of the low driving frequency and greater than the input frequency (e.g. 60 Hz) of the input image data IMG.

When the dithering part is activated and the average grayscale value of the segment at which the difference of the luminance is perceived by the user due to the dithering operation does not exist among the average grayscale values of the segments, the frequency adjuster may determine and set the driving frequency of the display panel 100 (the low frequency driving mode) in the same manner as when the dithering part is deactivated (or is not present).

When the dithering part is activated and the average grayscale value of the segment at which the difference of the luminance is perceived by the user due to the dithering operation does not exist among the average grayscale values of the segments, the frequency adjuster may determine the flicker values of the respective segments (operation S200), may determine a maximum driving frequency at which flicker is not shown to a user (operation S300), and may determine and set the maximum driving frequency as the driving frequency of the display panel 100 (operation S400) (the low frequency driving mode).

According to exemplary embodiments, the frequency adjuster may be disposed prior to the dithering part, the display apparatus may include the dithering determiner 210 determining whether the dithering part is activated, and the display apparatus may include the driving frequency determiner 230 determining and setting the driving frequency based on the input image data IMG and whether the dithering part is activated. Thus, the power consumption of the display apparatus may be reduced. In addition, flicker due to the operation of the dithering part may be prevented so that the display quality of the display panel 100 may be improved.

As is traditional in the field of the present inventive concept, exemplary embodiments are described, and illustrated in the drawings, in terms of functional blocks, units and/or modules. Those skilled in the art will appreciate that these blocks, units and/or modules are physically implemented by electronic (or optical) circuits such as logic circuits, discrete components, microprocessors, hard-wired circuits, memory elements, wiring connections, etc., which may be formed using semiconductor-based fabrication techniques or other manufacturing technologies. In the case of the blocks, units and/or modules being implemented by microprocessors or similar, they may be programmed using software (e.g., microcode) to perform various functions discussed herein and may optionally be driven by firmware and/or software. Alternatively, each block, unit and/or module may be implemented by dedicated hardware, or as a combination of dedicated hardware to perform some functions and a processor (e.g., one or more programmed microprocessors and associated circuitry) to perform other functions. Also, each block, unit and/or module of the exemplary embodiments may be physically separated into two or more interacting and discrete blocks, units and/or modules without departing from the scope of the present inventive concept. Further, the blocks, units and/or modules of the exemplary embodiments may be physically combined into more complex blocks, units and/or modules without departing from the scope of the present inventive concept.

According to exemplary embodiments of the present inventive concept as described above, the power consumption of the display apparatus may be reduced and the display quality of the display panel may be improved.

While the present inventive concept has been particularly shown and described with reference to the exemplary embodiments thereof, it will be understood by those of ordinary skill in the art that various changes in form and detail may be made therein without departing from the spirit and scope of the present inventive concept as defined by the following claims.

What is claimed is:

1. A display apparatus, comprising:

a display panel configured to display an image based on input image data;

a data driver configured to output a data voltage to the display panel; and a driving controller comprising a frequency adjuster circuit configured to determine a driving frequency of the display panel, and a dithering circuit configured to change a grayscale value of the input image data according to frames, wherein the frequency adjuster circuit is further configured to determine whether the dithering circuit is activated, wherein the frequency adjuster circuit is configured to determine the driving frequency of the display panel after determining whether the dithering circuit is activated based on the input image data and based on whether the dithering circuit is activated.

2. The display apparatus of claim 1, wherein the frequency adjuster circuit is disposed prior to the dithering circuit in the driving controller.

3. The display apparatus of claim 2, wherein the frequency adjuster circuit comprises:

a dithering determiner circuit configured to determine whether the dithering circuit is activated;

a still image determiner circuit configured to determine whether the input image data represent a still image or a video image;

a flicker value storage configured to store a plurality of flicker values for a plurality of corresponding grayscale values of the input image data; and a driving frequency determiner circuit configured to determine the driving frequency of the display panel based on at least one of the flicker values and based on whether the dithering circuit is activated.

4. The display apparatus of claim 3, wherein when the dithering circuit is deactivated, the frequency adjuster circuit is configured to determine the flicker values of respective pixels, and set a maximum driving frequency in which a flicker is not visible to a user as the driving frequency of the display panel based on the flicker values of the respective pixels.

5. The display apparatus of claim 3, wherein when the dithering circuit is activated, the frequency adjuster circuit is configured to determine whether a grayscale value of a pixel at which a difference of a luminance is visible to a user due to a dithering operation performed by the dithering circuit exists among grayscale values of the pixels.

6. The display apparatus of claim 5, wherein when the dithering circuit is activated and the grayscale value of the pixel at which the difference of the luminance is visible to the user exists among the grayscale values of the pixels, the frequency adjuster circuit is configured to set the driving frequency of the display panel to a predetermined dithering frequency.

7. The display apparatus of claim 5, wherein when the dithering circuit is activated and the grayscale value of the pixel at which the difference of the luminance is visible to the user does not exist among the grayscale values of the pixels, the frequency adjuster circuit is configured to determine the flicker values of respective pixels and set a maximum driving frequency at which a flicker is not visible to the user as the driving frequency of the display panel based on the flicker values of the respective pixels.

8. The display apparatus of claim 5, wherein the grayscale value of the pixel at which the difference of the luminance is visible to the user is about equal to or greater than a reference grayscale value.

9. The display apparatus of claim 5, wherein the grayscale value of the pixel at which the difference of the luminance is visible to the user is about equal to or less than a reference grayscale value.

10. The display apparatus of claim 5, wherein the grayscale value of the pixel at which the difference of the luminance is visible to the user is about equal to or greater than a first reference grayscale value and less than a second reference grayscale value.

11. The display apparatus of claim 2, wherein the display panel comprises a plurality of segments, and the frequency adjuster circuit comprises:

a dithering determiner circuit configured to determine whether the dithering circuit is activated;

a still image determiner circuit configured to determine whether the input image data represent a still image or a video image;

a flicker value storage configured to store a plurality of flicker values for the segments of the input image data; and a driving frequency determiner circuit configured to determine the driving frequency of the display panel based on at least one of the flicker values and based on whether the dithering circuit is activated.

12. The display apparatus of claim 11, wherein when the dithering circuit is deactivated, the frequency adjuster circuit is configured to determine the flicker values of respective segments, and set a maximum driving frequency at which a flicker is not visible to a user as the driving frequency of the display panel based on the flicker values of the respective segments.

13. The display apparatus of claim 11, wherein when the dithering circuit is activated, the frequency adjuster circuit is configured to determine whether an average grayscale value of a segment at which a difference of a luminance is visible to a user due to a dithering operation performed by the dithering circuit exists among average grayscale values of the segments.

14. The display apparatus of claim 13, wherein when the dithering circuit is activated and the average grayscale value of the segment at which the difference of the luminance is visible to the user exists among the average grayscale values of the segments, the frequency adjuster circuit is configured to set the driving frequency of the display panel to a predetermined dithering frequency.

15. The display apparatus of claim 13, wherein when the dithering circuit is activated and the average grayscale value of the segment at which the difference of the luminance is visible to the user does not exist among the average grayscale values of the segments, the frequency adjuster circuit is configured to determine the flicker values of respective segments and set a maximum driving frequency at which a flicker is not visible to the user as the driving frequency of the display panel based on the flicker values of the respective segments.

16. A method of driving a display panel, comprising:

determining a driving frequency of the display panel using a frequency adjuster circuit;

changing a grayscale value of input image data input to the display panel according to frames using a dithering circuit;

determining whether the dithering circuit is activated using the frequency adjuster circuit; and outputting a data voltage to the display panel based on the driving frequency of the display panel, wherein the frequency adjuster circuit is configured to determine the driving frequency of the display panel after determining whether the dithering circuit is activated based on the input image data and based on whether the dithering circuit is activated.

17. The method of claim 16, wherein the frequency adjuster circuit is disposed prior to the dithering circuit in a driving controller.

18. The method of claim 17, wherein the frequency adjuster circuit comprises:

a dithering determiner circuit configured to determine whether the dithering circuit is activated;

a still image determiner circuit configured to determine whether the input image data represent a still image or a video image;

a flicker value storage configured to store a plurality of flicker values for a plurality of corresponding grayscale values of the input image data; and a driving frequency determiner circuit configured to determine the driving frequency of the display panel based on at least one of the flicker values and based on whether the dithering circuit is activated.

19. The method of claim 18, wherein determining the driving frequency of the display panel comprises:

determining the flicker values of respective pixels; and setting a maximum driving frequency at which a flicker is not visible to a user as the driving frequency of the display panel based on the flicker values of the respective pixels, when the dithering circuit is deactivated.

20. The method of claim 18, wherein determining the driving frequency of the display panel comprises:

determining whether a grayscale value of a pixel at which a difference of a luminance is visible to a user due to a dithering operation performed by the dithering circuit exists among grayscale values of the pixels, when the dithering circuit is activated.

* * * * *